US007555923B2

(12) United States Patent
Kim et al.

(10) Patent No.: US 7,555,923 B2
(45) Date of Patent: Jul. 7, 2009

(54) DETERGENT-SUPPLY SYSTEM AND WASHING MACHINE USING THE SAME

(75) Inventors: Gon Kim, Jinhae-si (KR); Jae Kyum Kim, Kimhae-si (KR); Chi Wan Hur, Changwon-si (KR)

(73) Assignee: LG Electronics Inc., Seoul (KR)

( * ) Notice: Subject to any disclaimer, the term of this patent is extended or adjusted under 35 U.S.C. 154(b) by 343 days.

(21) Appl. No.: 11/048,710

(22) Filed: Feb. 3, 2005

(65) Prior Publication Data

US 2005/0210927 A1 Sep. 29, 2005

(30) Foreign Application Priority Data

Feb. 6, 2004 (KR) ..... 10-2004-0007881

(51) Int. Cl.
*D06F 39/02* (2006.01)

(52) U.S. Cl. ..... 68/17 R; 68/207

(58) Field of Classification Search ..... 68/207, 68/17 R; 134/93, 184, 198
See application file for complete search history.

(56) References Cited

U.S. PATENT DOCUMENTS

| | | | | |
|---|---|---|---|---|
| 2,988,908 | A * | 6/1961 | Gerhardt | 68/17 R |
| 3,027,741 | A * | 4/1962 | Bullock et al. | 68/17 R |
| 3,159,016 | A * | 12/1964 | Hertig et al. | 68/17 R |
| 3,406,876 | A * | 10/1968 | Steele et al. | 222/630 |
| 3,975,931 | A * | 8/1976 | Bischkopf | 68/17 R |
| 4,700,554 | A * | 10/1987 | Eichman et al. | 68/17 R |
| 5,375,438 | A * | 12/1994 | Babuin | 68/17 R |
| 5,875,655 | A * | 3/1999 | Herman-Latack et al. | 68/17 R |
| 5,884,506 | A * | 3/1999 | Blauert et al. | 68/17 R |
| 6,227,012 | B1 * | 5/2001 | Borroni et al. | 68/17 R |
| 6,250,118 | B1 * | 6/2001 | Kim | 68/17 R |
| 6,826,933 | B2 * | 12/2004 | Merkle et al. | 68/17 R |
| 7,093,467 | B2 * | 8/2006 | Kim et al. | 68/17 R |

FOREIGN PATENT DOCUMENTS

| | | | |
|---|---|---|---|
| DE | 2038324 | A1 | 8/1970 |
| DE | 2947330 | A1 | 5/1981 |
| DE | 3803196 | A1 | 8/1989 |
| FR | 2421235 | A | 10/1979 |
| FR | 2 530 687 | * | 1/1984 |
| FR | 2 632 984 | * | 12/1989 |

(Continued)

OTHER PUBLICATIONS

European Patent Office 0 318 070 Oct. 1988.*

(Continued)

*Primary Examiner*—Frankie L Stinson
(74) *Attorney, Agent, or Firm*—Birch, Stewart, Kolasch & Birch, LLP

(57) ABSTRACT

A detergent-supply system and a washing machine using the same. The detergent-supply system includes a guide rib formed on the bottom surface of a housing for guiding wash water, supplied to the rear part of the housing, to the front part of the housing, thereby washing out detergent remaining in the front part of the housing. The detergent-supply system further includes slits formed in the guide rib for spraying wash water, thereby completely eliminating the detergent remaining on the bottom surface of the housing.

18 Claims, 5 Drawing Sheets

FOREIGN PATENT DOCUMENTS

| | | | |
|---|---|---|---|
| JP | 63-171592 | * | 7/1988 |
| JP | 63-270098 | * | 11/1988 |
| JP | 2-174898 | * | 7/1990 |
| JP | 3-215296 | * | 9/1991 |
| JP | 10-127982 | * | 5/1998 |
| JP | 2000-342894 | * | 12/2000 |

OTHER PUBLICATIONS

European Patent Office 0 331 920 Feb. 1989.*

European Patent Office 169 604 Jan. 1986.*

* cited by examiner

DETERGENT-SUPPLY SYSTEM AND WASHING MACHINE USING THE SAME

BACKGROUND OF THE INVENTION

1. Field of the Invention

The present invention relates to a detergent-supply system and a washing machine using the same, and more particularly to a detergent-supply system for converting a channel of water so as to fully eliminate remaining detergent and a washing machine using the same.

2. Description of the Related Art

Generally, a washing machine is an apparatus for washing laundry, such as clothing and bedding, using action of wash water and detergent through washing, rinsing, and dehydrating operations, thereby removing contaminants from the laundry.

Since detergent is directly poured into a tub of the conventional washing machine, it is difficult to pour a proper quantity of the detergent and the laundry may be discolored. Accordingly, a separated detergent-supply unit is installed at the upper part of the washing machine.

FIG. 1 is a perspective view of a conventional washing machine. FIG. 2 is a longitudinal sectional view of the conventional washing machine. FIG. 3 is a transverse sectional view of a conventional detergent-supply system.

As shown in FIGS. 1 to 3, a detergent-supply system of the conventional washing machine 10 comprises a housing 20 installed at the upper part of the washing machine 10 and provided with an outlet 22 formed through one side thereof, and a detergent container 30 slidably installed in the housing 20 for containing detergent.

The bottom surface of the housing 20 is inclined so that the detergent and the wash water flow towards the outlet 22, and the outlet 22 is connected to a water supply hole of a tub 12 through a water supply bellows 14.

The detergent container 30 includes a hand lever 32 formed on the front surface thereof so that the hand lever 32 is drawn by a user, and an opening 34 formed through the rear part thereof so that the detergent and the wash water are discharged from the detergent container 30 to the housing 20 through the opening 34.

Hereinafter, operation of the above-described detergent-supply system of the conventional washing machine will be described in detail.

First, the wash water, which is supplied to the detergent container 30, is mixed with the detergent in the detergent container 30, and the mixture flows downwardly through the opening 34 of the detergent container 30 and is supplied to the rear part of the housing 20.

The wash water and the detergent, which were supplied to the housing 20, are discharged to the outlet 22 of the housing 20 along the inclined bottom surface of the housing 20.

The wash water and the detergent, which passed through the outlet 22, are supplied to the tub 12 through the water supply bellows 14 connected to the outlet 22.

In the conventional detergent-supply system, a portion of the wash water, which flowed from the detergent container 30 to the rear part of the housing 20, is pushed to the front part of the housing 20 opposite to the outlet 22 by the pressure of the water, and the detergent together with the wash water is pushed to the front part of the housing 20, thereby remaining in the front part of the housing 20.

When the detergent, which was pushed to the front part of the housing 20, remains on the bottom surface of the housing 20, a fixed quantity of the detergent cannot be used to wash the laundry. Further, the remaining detergent is solidified, and, when the remaining detergent is dissolved in water during a rinsing operation, rinsing capacity is deteriorated.

Since the wash water flows to the rear part of the housing 20, and is discharged to the outside of the housing 20 through the outlet 22, the detergent remaining in the front part of the housing 20 cannot be dissolved in the wash water. Accordingly, a separate device for supplying water to the front part of the housing 20 is additionally required.

SUMMARY OF THE INVENTION

Therefore, the present invention has been made in view of the above problems, and it is an object of the present invention to provide a detergent-supply system for washing out remaining detergent and a washing machine using the same.

In accordance with the present invention, the above and other objects can be accomplished by the provision of a detergent-supply system and a washing machine using the same, the detergent-supply system comprising: a housing provided with an outlet formed through one side thereof for discharging detergent and supplied water; a detergent container installed in the housing for containing the detergent therein and supplying the detergent and the supplied water to the housing; and a guide unit installed on the bottom surface of the housing for guiding the supplied water to the other side of the housing opposite to the outlet so that the detergent remaining on the bottom surface of the housing is washed out by the supplied water.

Preferably, the guide unit may be a guide rib protruded from the bottom surface of the housing in a longitudinal direction.

Further, preferably, the bottom surface of the housing (60) may include left and right inclined portions respectively extended from both side surfaces of the housing and inclined downwardly, and a bottom portion connecting the left and right inclined portions.

Moreover, preferably, the guide rib may be formed on at least one of the left and right inclined portions.

More preferably, one end of the guide rib may contact the rear surface of the housing, and the other end of the guide rib may be separated from the opened front surface of the housing by a designated interval.

Preferably, slits for partially spraying the water guided along the guide rib may be formed in the guide rib.

Further, preferably, the slits may be prepared in plural number.

Moreover, preferably, a plurality of the slits may be separated from one another by a designated interval in the longitudinal direction of the guide rib.

Preferably, the slits may be formed in the top end of the guide rib.

More preferably, the slits may be U-shaped.

Since the guide rib installed on the bottom surface of the housing guides water, supplied to the rear part of the housing, to the front part of the housing, the detergent-supply system and the washing machine using the same are advantageous in that the detergent remaining in the front part of the housing is washed out by the water.

Further, since the water is sprayed through the slits formed in the guide rib, the detergent-supply system and the washing machine using the same are advantageous in that the detergent remaining on the bottom surface of the housing is completely washed out by the water.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, a preferred embodiment of the present invention will be described in detail with reference to the annexed drawings.

Figure 1:
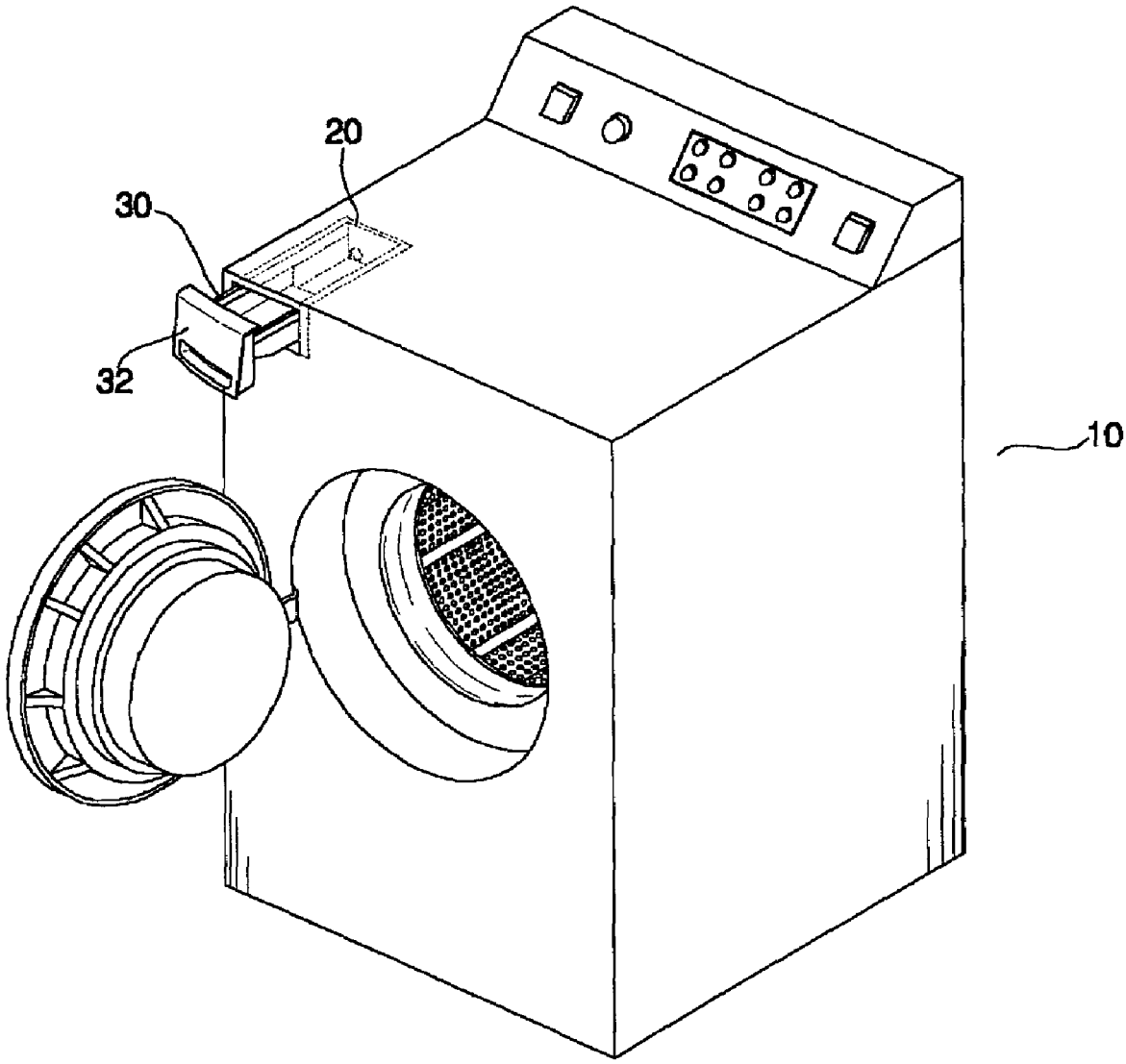
FIG. 1 (Prior art)
FIG. 1 is a perspective view of a conventional washing machine.
Figure 2:
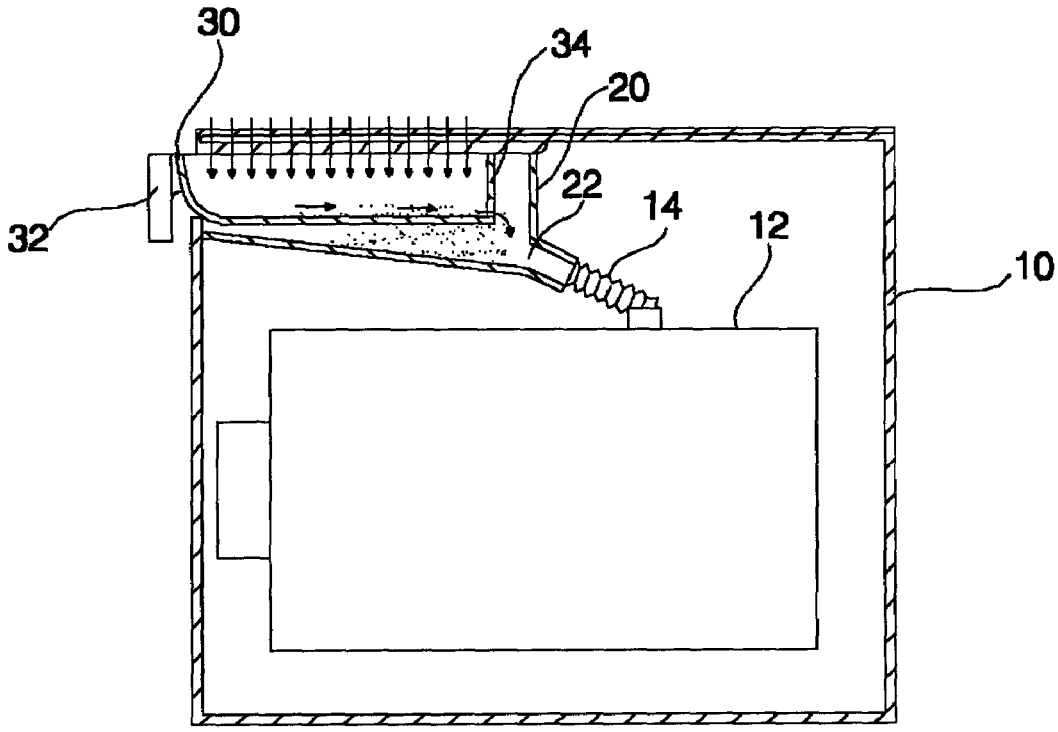
FIG. 2 (Prior art)
FIG. 2 is a longitudinal sectional view of the conventional washing machine.
Figure 3:
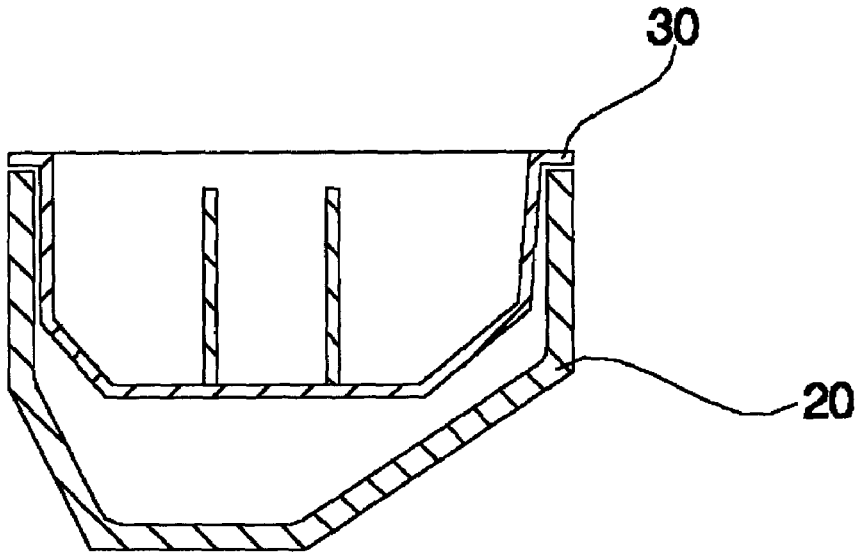
FIG. 3 (Prior art)
FIG. 3 is a transverse sectional view of a conventional detergent-supply system.
Figure 4:
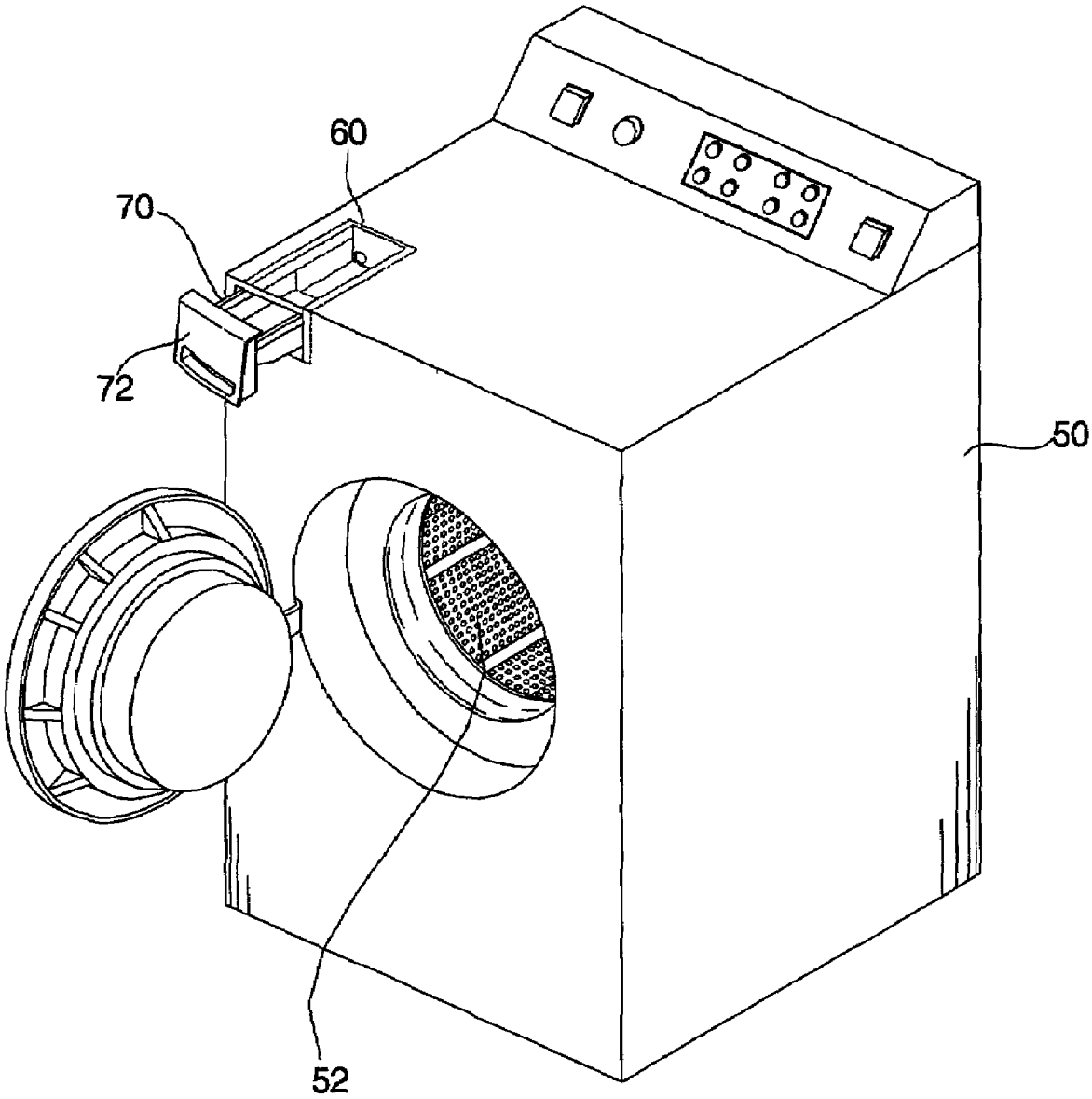
FIG. 4 is a perspective view of a washing machine having a detergent-supply system in accordance with the present invention.
Figure 5:
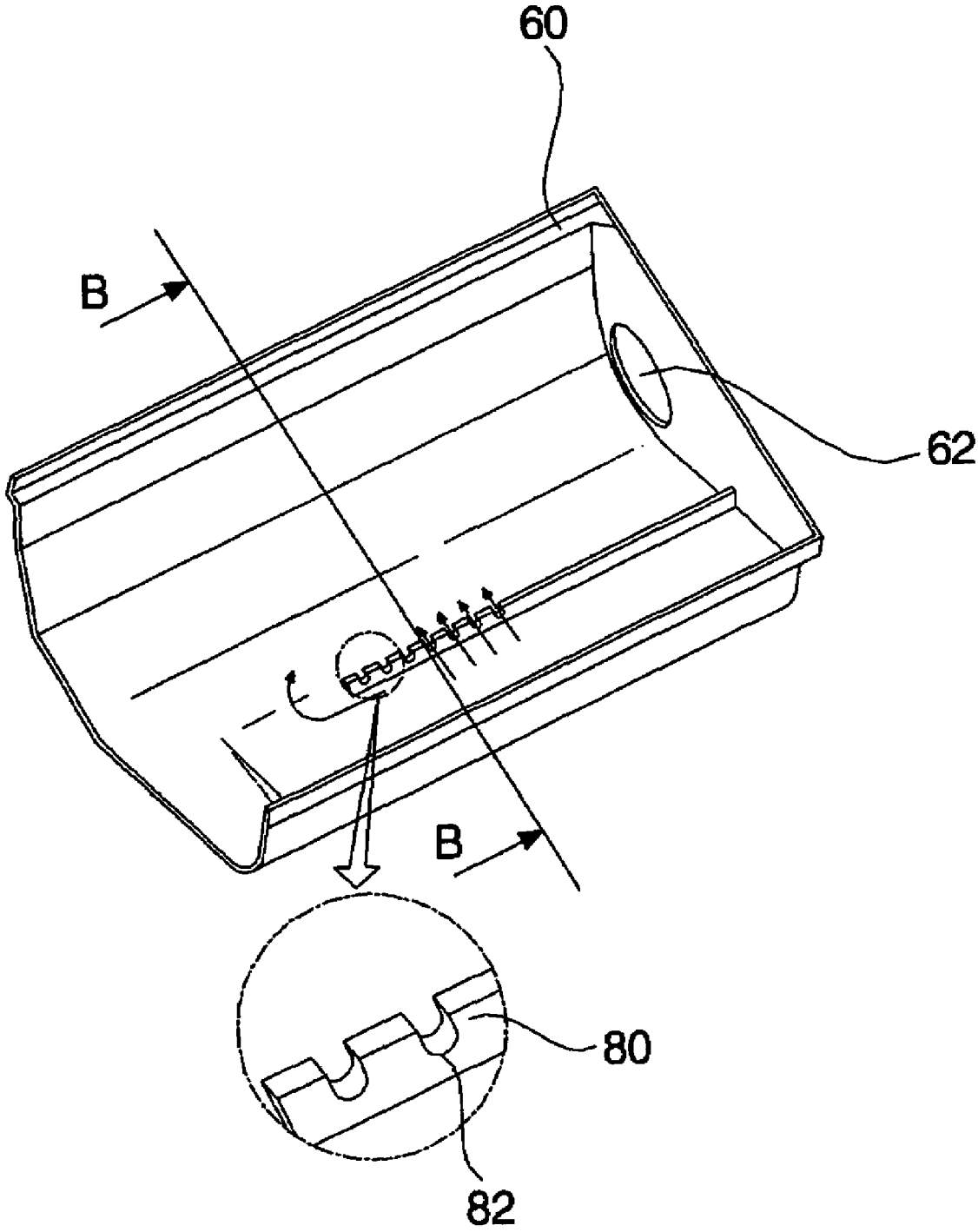
FIG. 5 is a perspective view of a housing, in which a guide rib is installed, of the detergent-supply system in accordance with the present invention.
Figure 6:
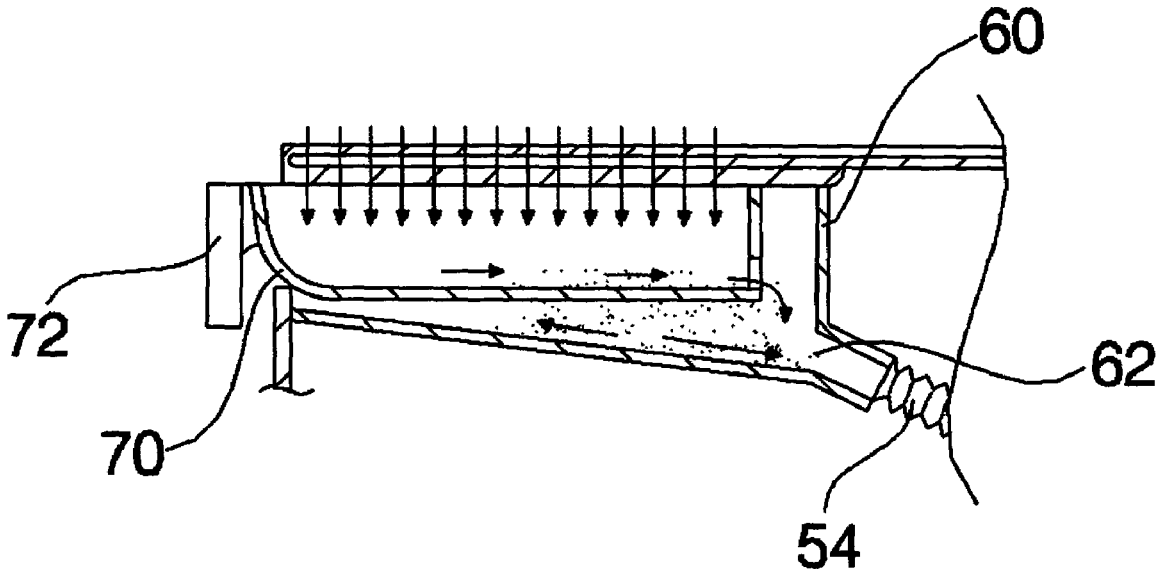
FIG. 6 is a longitudinal sectional view of the detergent-supply system in accordance with the present invention.
Figure 7:
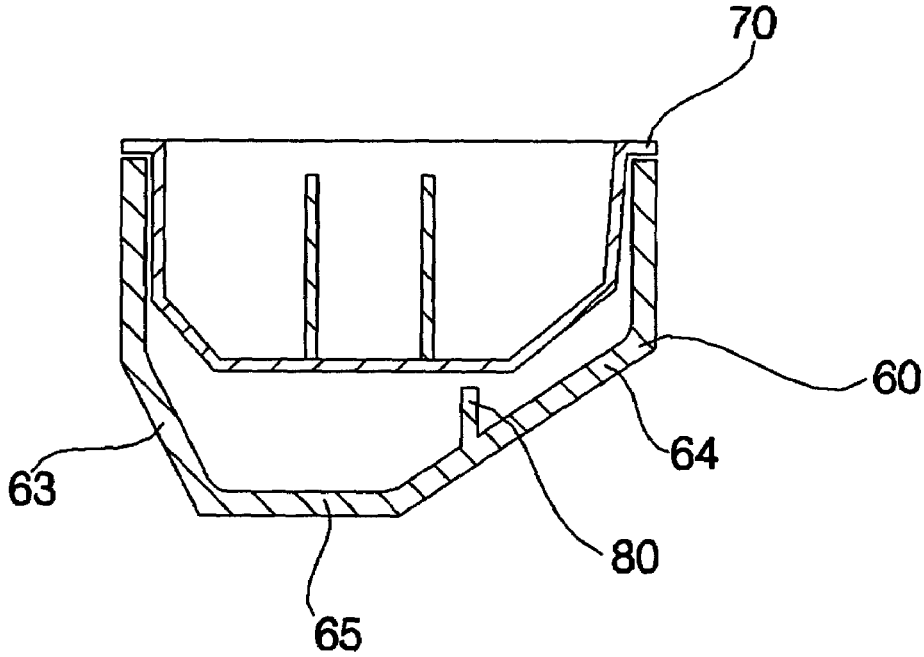
FIG. 7 is a transverse sectional view of the detergent-supply system in accordance with the present invention.

FIG. 4 is a perspective view of a washing machine having a detergent-supply system in accordance with the present invention. FIG. 5 is a perspective view of a housing, in which a guide rib is installed, of the detergent-supply system in accordance with the present invention. FIG. 6 is a longitudinal sectional view of the detergent-supply system in accordance with the present invention. FIG. 7 is a transverse sectional view of the detergent-supply system in accordance with the present invention.

As shown in FIGS. 4 to 7, the detergent-supply system of the washing machine of the present invention comprises a housing 60 provided with an outlet 62, installed at one side thereof for discharging detergent and supplied wash water, and an inclined bottom surface, a detergent container 70 installed in the housing 60 for containing the detergent, and a guide unit formed on the bottom surface of the housing 60 for guiding the supplied water to the other side of the housing 60 opposite to the outlet 62.

The housing 60 is installed in an upper part of the washing machine, and the outlet 62 is connected to a water supply hole (not shown) of a tub so that the detergent and the wash water are supplied to the tub (not shown) through the outlet 62.

The tub (not shown) is horizontally installed in a cabinet 50 forming the external appearance of the washing machine, a drum 52 is rotatably installed in the tub, and a water supply hose 54 is connected to the water supply hole of the tub.

One end of the water supply hose 54 is connected to the water supply hole of the tub so that the detergent and the wash water discharged from the housing 60 are supplied to the tub, and the other end of the water supply hose 54 is connected to the outlet 62 of the housing 60.

The bottom surface of the housing 60 is inclined such the height of the bottom surface is decreased from the front part to the rear part provided with the outlet 62, thereby allowing the detergent and the wash water, discharged from the detergent container 70, to flow towards the outlet 62 via inertia of water.

That is, the bottom surface of the housing 60 includes left and right inclined portions 63 and 64, which are respectively extended from both side surfaces and inclined downwardly, and a bottom portion 65 for connecting the left and right inclined portions 63 and 64.

Front and upper surfaces of the housing 60 are opened, and the outlet 62 is formed through a rear surface of the housing 60.

The detergent container 70 is slidably installed on the upper surface of the housing 60, and includes a hand lever 72 installed at the front surface thereof and an opening formed through the rear surface thereof for discharging the wash water mixed with the detergent to the housing 60.

The guide unit is a guide rib 80 protruded from the bottom surface of the housing 80.

The guide rib 80 may be formed on at least one of the left and right inclined portions 63 and 64 of the housing 60. In the present invention, the guide rib 80 is formed on the right inclined portion 64 having a gradient slower than that of the left inclined portion 63.

The guide rib 80 is longitudinally extended from the rear surface of the housing 60, through which the outlet 62 is formed, in the direction opposite to the outlet 62.

That is, one end of the guide rib 80 contacts the rear surface of the housing 60, and the other end of the guide rib 80 is separated from the opened front surface of the housing 60 by a designated interval.

Slits 82 for partially spraying the wash water guided by the guide rib 80 are formed in the guide rib 80.

The slits 82 are prepared in plural number so that the wash water is sprayed by the slits 82 and flows to the bottom surface of the housing 60. Here, a plurality of the slits 82 are separated from one another by a designated interval in a longitudinal direction of the guide rib 80.

The slits 82 are formed in the upper end of the guide rib 80, and have U-shapes so that stress is not concentrated and foreign substances, such as the detergent, are not stacked on the slits 82.

Hereinafter, operation of the detergent-supply system of the present invention will be described in detail.

First, when wash water is supplied to the inside of the detergent container 70, the wash water is mixed with detergent in the detergent container 70, and the mixture flows to the housing 60 through the opening of the detergent container 70.

The detergent and the wash water, which are located in the rear part of the housing 60, flow to the outlet 62 along the inclined bottom surface of the housing 60, and are supplied to the tub (not shown) through the outlet 62.

Here, a portion of the detergent is pushed to the front part of the housing 60 opposite to the outlet 62, and is not discharged to the tub through the outlet 62 but remains in the housing 60.

The guide rib 80 guides the wash water, which is supplied into the housing 60, to the front part of the housing 60 opposite to the outlet 62, and converts a channel of the wash water so that the remaining detergent in the front part of the housing 60 is dissolved in the wash water.

That is, the guide rib 80 blocks a portion of the wash water, which is supplied into the housing 60, so that the portion of the wash water does not flow to the outlet 62 but flows to the front part of the housing 60 opposite to the outlet 62.

The portion of the wash water flowing along the guide rib 80 is discharged through the slits 82 formed in the guide rib 80, and is sprayed in a direction perpendicular to the guide rib 80, thereby washing out the detergent remaining on the bottom surface of the housing 60.

Accordingly, the wash water, which flows to the front part of the housing 60 along the guide rib 80, flows along the inclined bottom surface of the housing 60, thereby washing out the remaining detergent.

As apparent from the above description, the present invention provides a detergent-supply system, in which a guide rib installed on the bottom surface of a housing guides wash water, flowing towards the rear part of the housing, to the front part of the housing, and a washing machine using the detergent-supply system, thereby washing our detergent remaining in the front part of the housing.

Further, the wash water is sprayed through slits formed in the guide rib, thereby completely eliminating the detergent remaining on the bottom surface of the housing.

Although the preferred embodiment of the present invention has been disclosed for illustrative purposes, those skilled in the art will appreciate that various modifications, additions and substitutions are possible, without departing from the scope and spirit of the invention as disclosed in the accompanying claims.

What is claimed is:

1. A detergent-supply system comprising:

a housing provided with an outlet formed at a rear side thereof for discharging detergent and supplied water;

a detergent container installed in the housing for containing the detergent therein and supplying the detergent and the supplied water to a rear part of the housing; and a guide unit installed on the bottom surface of the housing to guide the supplied water supplied from the detergent container to the rear part of the housing to flow towards a front part of the housing opposite to the outlet and then towards the outlet so that the detergent remaining on the bottom surface of the housing is washed out by the supplied water, wherein the guide unit is a guide rib protruded from the bottom surface of the housing in a longitudinal direction.

2. The detergent-supply system as set forth in claim 1, wherein the bottom surface of the housing includes left and right inclined portions respectively extended from both side surfaces of the housing and inclined downwardly, and a bottom portion connecting the left and right inclined portions.

3. The detergent-supply system as set forth in claim 1, wherein slits for partially spraying the water guided along the guide rib are formed in the guide rib.

4. The detergent-supply system as set forth in claim 3, wherein the slits are prepared in plural number.

5. The detergent-supply system as set forth in claim 4, wherein a plurality of the slits are separated from one another by a designated interval in the longitudinal direction of the guide rib.

6. A detergent-supply system comprising:

a housing provided with an outlet formed through one side thereof for discharging detergent and supplied water;

a detergent container installed in the housing for containing the detergent therein and supplying the detergent and the supplied water to the housing; and a guide unit installed on the bottom surface of the housing for guiding the supplied water to the other side of the housing opposite to the outlet so that the detergent remaining on the bottom surface of the housing is washed out by the supplied water, wherein the guide unit is a guide rib protruded from the bottom surface of the housing in a longitudinal direction, wherein the bottom surface of the housing includes left and right inclined portions respectively extended from both side surfaces of the housing and inclined downwardly, and a bottom portion connecting the left and right inclined portions, and wherein the guide rib is formed on at least one of the left and right inclined portions.

7. The detergent-supply system as set forth in claim 6, wherein one end of the guide rib contacts the rear surface of the housing, and the other end of the guide rib is separated from the opened front surface of the housing by a designated interval.

8. A detergent-supply system comprising:

a housing provided with an outlet formed through one side thereof for discharging detergent and supplied water;

a detergent container installed in the housing for containing the detergent therein and supplying the detergent and the supplied water to the housing; and a guide unit installed on the bottom surface of the housing for guiding the supplied water to the other side of the housing opposite to the outlet so that the detergent remaining on the bottom surface of the housing is washed out by the supplied water, wherein the guide unit is a guide rib protruded from the bottom surface of the housing in a longitudinal direction, wherein slits for partially spraying the water guided along the guide rib are formed in the guide rib, and wherein the slits are formed in the top end of the guide rib.

9. The detergent-supply system as set forth in claim 8, wherein the slits are U-shaped.

10. A detergent-supply device and a washing machine using the same, said detergent-supply device comprising:

a drum rotatably installed in a tub;

a water supply hose, one end of which is connected to a water supply hole of the tub;

a housing, to which the other end of the water supply hose is connected, provided with an outlet formed through one side thereof for discharging detergent and supplied water;

a detergent container installed in the housing for containing the detergent therein and supplying the detergent and the supplied water to the housing; and a guide unit installed on the bottom surface of the housing for guiding the supplied water supplied from the detergent container to the rear part of the housing towards a front part of the housing opposite to the outlet and then towards the outlet so that the detergent remaining on the bottom surface of the housing is washed out by the supplied waters, wherein the guide unit is a guide rib protruded from the bottom surface of the housing in a longitudinal direction.

11. The detergent-supply system and the washing machine using the same as set forth in claim 10, wherein the bottom surface of the housing includes left and right inclined portions respectively extended from both side surfaces of the housing and inclined downwardly, and a bottom portion connecting the left and right inclined portions.

12. The detergent-supply system and the washing machine using the same as set forth in claim 10, wherein slits for partially spraying the water guided along the guide rib are formed in the guide rib.

13. The detergent-supply system and the washing machine using the same as set forth in claim 12, wherein the slits are prepared in plural number such that the slits are separated from one another by a designated interval in the longitudinal direction of the guide rib.

14. A detergent-supply device and a washing machine using the same, said detergent supply device comprising:

a drum rotatably installed in a tub;

a water supply hose, one end of which is connected to a water supply hole of the tub a housing, to which the other end of the water supply hose is connected, provided with an outlet formed through one side thereof for discharging detergent and supplied water;

a detergent container installed in the housing for containing the detergent therein and supplying the detergent and the supplied water to the housing; and a guide unit installed on the bottom surface of the housing for guiding the supplied water to the other side of the housing opposite to the outlet so that the detergent remaining on the bottom surface of the housing is washed out by the supplied water, wherein the guide unit is a guide rib protruded from the bottom surface of the housing in a longitudinal direction, wherein the bottom surface of the housing includes left and right inclined portions respectively extended from both side surfaces of the housing and inclined downwardly, and a bottom portion connecting the left and right inclined portions, and wherein the guide rib is formed on at least one of the left and right inclined portions.

15. The detergent-supply system and the washing machine using the same as set forth in claim 14, wherein one end of the guide rib contacts the rear surface of the housing, and the other end of the guide rib is separated from the opened front surface of the housing by a designated interval.

16. A detergent-supply device and a washing machine using the same, said detergent-supply device comprising:

a drum rotatably installed in a tub;

a water supply hose, one end of which is connected to a water supply hole of the tub;

a housing, to which the other end of the water supply hose is connected, provided with an outlet formed through one side thereof for discharging detergent and supplied water;

a detergent container installed in the housing for containing the detergent therein and supplying the detergent and the supplied water to the housing; and a guide unit installed on the bottom surface of the housing for guiding the supplied water to the other side of the housing opposite to the outlet so that the detergent remaining on the bottom surface of the housing is washed out by the supplied water, wherein the guide unit is a guide rib protruded from the bottom surface of the housing in a longitudinal direction, wherein slits for partially spraying the water guided along the guide rib are formed in the guide rib, and wherein the slits are formed in the top end of the guide rib.

17. The detergent-supply system and the washing machine using the same as set forth in claim 16, wherein the slits are U-shaped.

18. A detergent-supply device and a washing machine using the same, said detergent-supply device comprising:

a drum rotatably installed in a tub;

a water supply hose, one end of which is connected to a water supply hole of the tub;

a housing, to which the other end of the water supply hose is connected, provided with an outlet formed through one side thereof for discharging detergent and supplied water;

a detergent container installed in the housing for containing the detergent therein and supplying the detergent and the supplied water to the housing; and a guide unit installed on the bottom surface of the housing for guiding the supplied water to the other side of the housing opposite to the outlet so that the detergent remaining on the bottom surface of the housing is washed out by the supplied water, wherein the guide unit is a guide rib protruded from the bottom surface of the housing in a longitudinal direction; and a plurality of slits having U-shapes for partially spraying the water guided along the guide rib are formed in the top end of the guide rib.

* * * * *